US006182536B1

(12) United States Patent
Roberts et al.

(10) Patent No.: US 6,182,536 B1
(45) **Date of Patent: *Feb. 6, 2001**

(54) HAND TOOL WITH RATCHET HANDLE AND ASSOCIATED QUICK RELEASE MECHANISM

(75) Inventors: Peter M. Roberts, Red Bank, TN (US); John B. Davidson, Chicago, IL (US)

(73) Assignee: JODA Enterprises, Inc., Chicago, IL (US)

( * ) Notice: Under 35 U.S.C. 154(b), the term of this patent shall be extended for 0 days.

This patent is subject to a terminal disclaimer.

(21) Appl. No.: 09/586,670

(22) Filed: Jun. 1, 2000

Related U.S. Application Data

(63) Continuation of application No. 09/210,519, filed on Dec. 11, 1998, now Pat. No. 6,098,500.

(51) Int. Cl.[7] ..... B25B 13/46
(52) U.S. Cl. ..... 81/63; 81/177.85
(58) Field of Search ..... 81/63, 63.1, 177.1, 81/177.4, 177.85, 438, 439

(56) References Cited

U.S. PATENT DOCUMENTS

| | | |
|---|---|---|
| 1,421,792 | 7/1922 | Linden . |
| 1,970,409 | 8/1934 | Wiedemann . |
| 3,312,260 | 4/1967 | MacNeill . |
| 3,575,069 | 4/1971 | White . |
| 3,824,881 | 7/1974 | Wright . |
| 4,235,269 | 11/1980 | Kraus . |
| 4,344,340 | 8/1982 | Erickson . |
| 5,289,745 | 3/1994 | Beardsley . |
| 5,333,523 | 8/1994 | Palm . |
| 5,517,884 | 5/1996 | Sanders . |
| 5,568,757 | 10/1996 | Lewis . |
| 5,586,475 | 12/1996 | Wenner . |
| 5,644,958 | 7/1997 | Roberts et al. . |
| 5,680,800 | 10/1997 | Sharpe . |
| 5,732,606 | 3/1998 | Chiang . |

*Primary Examiner*—James G. Smith
*Assistant Examiner*—David B. Thomas
(74) *Attorney, Agent, or Firm*—Brinks Hofer Gilson & Lione

(57) ABSTRACT

A hand tool includes a shaft and a rotatable handle that is coupled to the shaft bar by a ratchet mechanism. The disclosed ratchet mechanism provides a clockwise ratcheting action, a counterclockwise ratcheting action, and a freewheeling action, as selected by a ratchet control ring. The shaft bar includes a quick release mechanism using a symmetrical ring that facilitates assembly.

13 Claims, 2 Drawing Sheets

Fig. 2
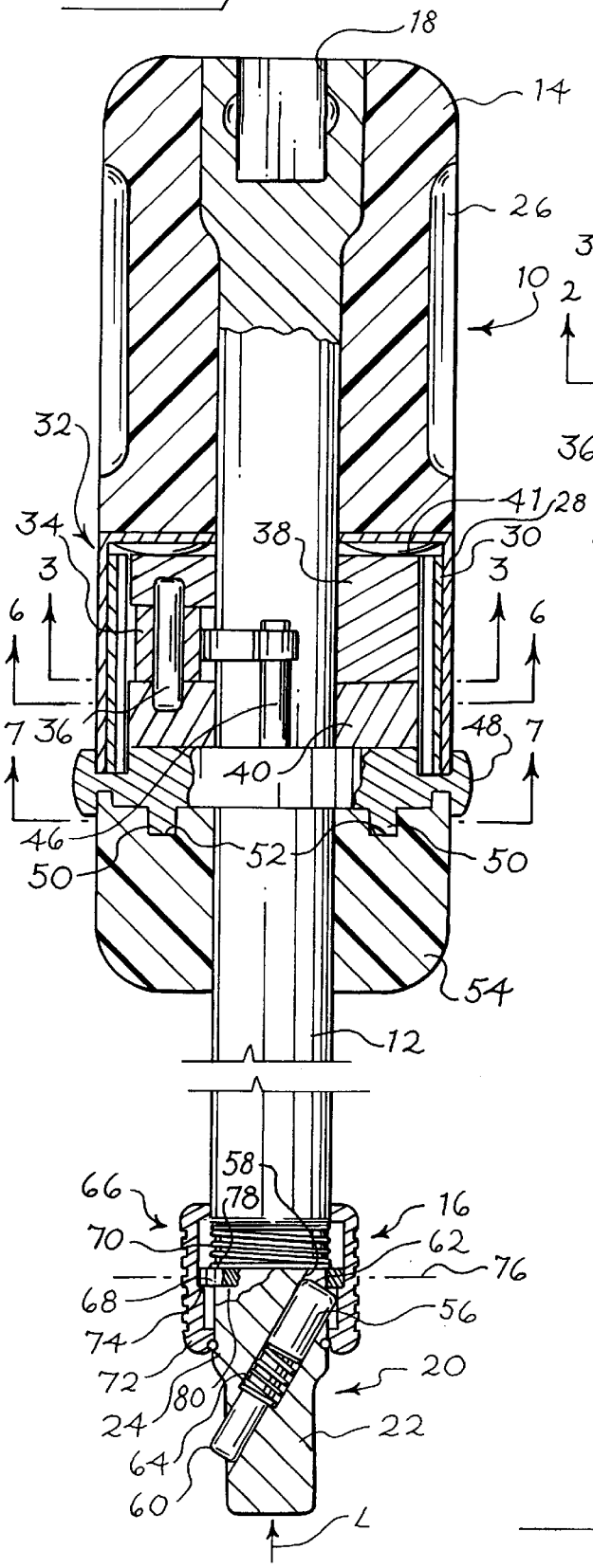
Fig. 3
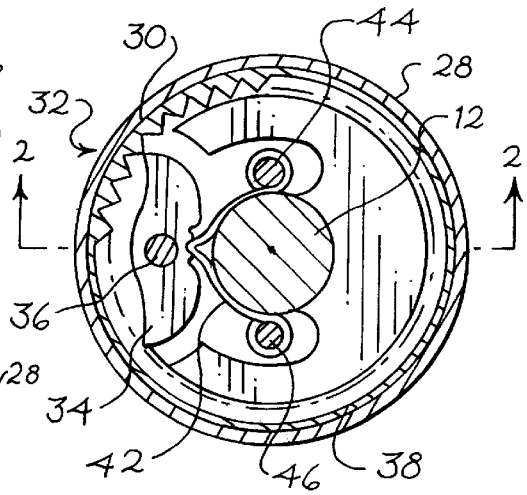
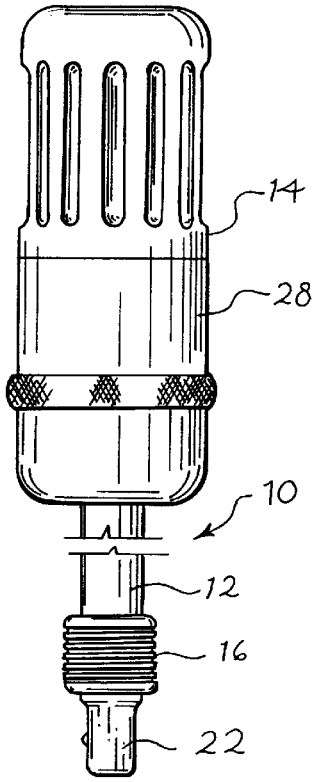
Fig. 1

HAND TOOL WITH RATCHET HANDLE AND ASSOCIATED QUICK RELEASE MECHANISM

This application is a continuation of application No. 09/210,519, filed Dec. 11, 1998 now U.S. Pat. No. 6,098,500.

BACKGROUND

This invention relates to hand tools, and in particular to an improved ratchet handle hand tool and quick release mechanism.

Sharpe U.S. Pat. No. 5,680,800 discloses a socket drive extension including a grip that is secured in place to the extension to rotate in unison with it. This grip provides a handle designed to allow the extension to be rotated manually, without the use of an attached wrench.

Wenner U.S. Pat. No. 5,586,475 and Chiang U.S. Pat. No. 5,732,606 disclose hand tools which include free-wheeling sleeves that form a hand grip.

Roberts U.S. Pat. No. 5,644,958, assigned to the assignee of the present invention, discloses a quick release mechanism for an extension bar. This quick release mechanism is well suited for a wide variety of applications.

SUMMARY

The present invention is defined by the following claims, and nothing in this section should be taken as a limitation on those claims.

By way of introduction, the preferred embodiment described below provides an extension bar with a ratcheting handle. This ratcheting handle provides advantages in use, because the user is not required to reposition his or her hand on the handle multiple times to provide continuous rotation in a selected direction. The preferred ratchet mechanism includes a neutral position in which the handle is allowed to free-wheel with respect to the extension bar.

The disclosed extension bar includes a quick release mechanism that is particularly simple and inexpensive to assemble. In particular, the illustrated quick release mechanism includes a pin that slides in an oblique passageway. The pin is biased in a selected direction by a spring that bears on a ring that in turn bears on the pin. This ring is symmetrical about a mid-plane oriented perpendicularly to the shaft, and thus the ring can be assembled in either orientation and still perform its function properly. This eliminates the need to orient the ring in a selected orientation at the time of assembly, and thereby simplifies assembly.

BRIEF DESCRIPTION OF THE DRAWINGS

FIG. 1 is an elevational view of an extension bar that incorporates a preferred embodiment of this invention.

FIG. 2 is a longitudinal sectional view in partial elevation of the extension bar of FIG. 1.

FIG. 3 is a cross-sectional view taken along line 3—3 of FIG. 2, showing the pawl in a neutral position.

DETAILED DESCRIPTION OF THE PRESENTLY PREFERRED EMBODIMENTS

Figure 4:
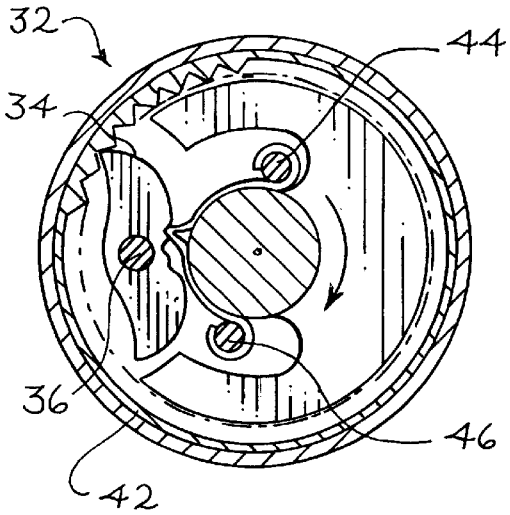
FIGS. 4 and 5 are cross-sectional views in the plane of FIG. 3, showing the pawl in first and second ratcheting positions, respectively.

Turning now to the drawings, FIG. 1 shows an extension bar 10 that incorporates a preferred embodiment of this invention. The extension bar 10 includes a longitudinally extending shaft 12 on which is mounted a ratcheting handle 14 and a quick release mechanism 16.

As shown in FIG. 2, the shaft 12 in this embodiment is a continuous, solid element that terminates in a drive socket 18 at a first end and a drive stud 20 at a second end. The drive socket 18 is formed with an out-of-round cross section which may, for example, be square or hexagonal. The drive socket 18 is adapted to receive the drive stud of a socket wrench (not shown) when the socket wrench is used to apply torque to the extension bar 10. The drive stud 20 includes an out-of-round drive portion 22 and an adjacent portion 24. The drive portion 22 is shaped to fit within a tool attachment (not shown) to apply torque to the tool attachment. The out-of-round drive portion 22 can be provided with any desired cross-sectional shape, and may for example, be generally square or hexagonal in cross section. The shaft 12 and the outer portion of the drive socket 18 may be substantially rotationally symmetrical about a longitudinal axis L.

The handle 14 is mounted around the shaft 12 and the drive socket 18, and is freely rotatable about the shaft 12. If desired, the handle 12 can include grooves 26 or other features to provide a comfortable gripping surface. A handle extension 28 is secured to the end of the handle 14, opposite the drive socket 18. The handle 14 and handle extension 28 may be shaped as desired, including both cylindrical and non-cylindrical shapes. The handle extension 28 supports on its inner surface a toothed element 30. The toothed element 30, the handle extension 28, and the handle 14 are secured together to rotate in unison about the longitudinal axis L without slippage therebetween. In alternative embodiments, the handle 14 may be integrally formed with the handle extension 28 and optionally with the toothed element 30.

The handle 14 is coupled to the shaft 12 by a ratchet mechanism 32 (FIGS. 2–5). Many varieties of ratchet mechanisms are known to those skilled in the art, and any suitable variant can be used, including both ratchet mechanisms that include teeth and pawls, and ratchet mechanisms that include clutches (solid or fluid). In this example, the ratchet mechanism 32 includes a pawl 34 that is pivotably mounted on a pin 36. The pin 36 in turn is supported by first and second pawl supports 38, 40. The first and second pawl supports 38, 40 are press-fit on the shaft 12 such that the pawl supports 38, 40 rotate in unison with the shaft 12 without any slippage therebetween. For smoothness of operation, a spring 41 may be provided to bias the handle 14 away from the pawl support 36 and toward the drive socket 18.

Figure 5:
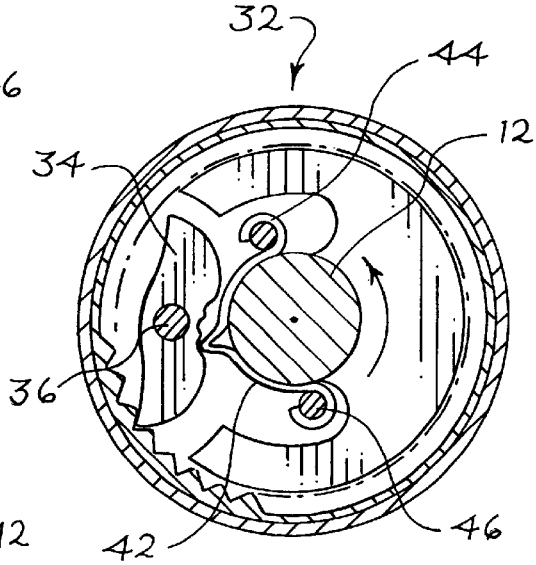
Figure 6:
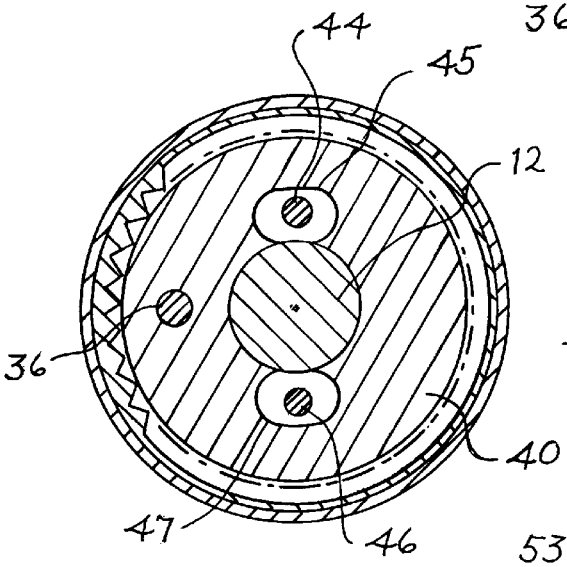
FIG. 6 is a cross-sectional view taken along line 6—6 of FIG. 2.
Figure 7:
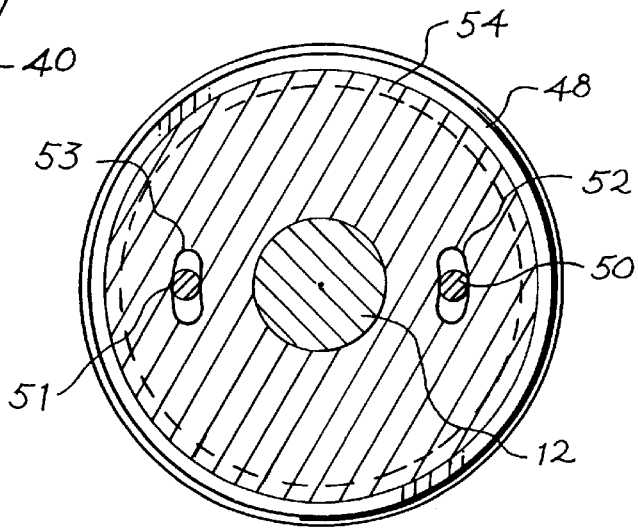
FIG. 7 is a cross-sectional view taken along line 7—7 of FIG. 2.

As best shown in FIGS. 3–5, the pawl 34 can be pivoted about the pin 36 to engage the toothed element 30 (FIG. 4, 5), or not to engage the toothed element (FIG. 3) The position of the pawl 34 about the pin 36 is controlled by a spring 42 that includes a central portion that bears directly on the rear surface of the pawl 34, and first and second ends that are looped around posts 44, 46. Returning to FIG. 2, the posts 44 (not shown), 46 are rigidly secured to a control ring 48 that is rotatable with respect to the shaft 12 about a limited arc of about 30° in this embodiment. FIG. 6 shows the manner in which the posts 44, 46 pass through arcuate slots 45, 47 in the pawl support 40. The control ring 48 includes first and second lugs 50, 51 that slide in arcuate slots 52, 53 in a control ring retainer 54 (FIG. 7). The control ring retainer 54 is press-fit in place on the shaft 12 such that there is substantially no rotational movement therebetween. The arcuate slots 52, 53 limit the range of travel of the lugs 50, 51 and thereby of the posts 44, 46 about the longitudinal axis L. The slots 52, 53 are preferably dimensioned to hold the posts 44, 46 out of substantial load-bearing contact with the pawl support 40 and thereby to protect the posts 44 46 from excessive shear loads.

Returning to FIG. 3, the spring 42 is shown in a centered position on the pawl 34. In this centered position the spring 42 operates as a means for holding the pawl 34 in a neutral position, in which the pawl 34 is maintained out of contact with the toothed element 30 and the handle 14 is allowed to free-wheel about the longitudinal axis L with respect to the shaft 12. A detent mechanism can be provided at any suitable location, as for example in conjunction with the lugs 50, 51 or the rear surface of the pawl 34 (FIG. 3), to hold the pawl 34 in the neutral position. In this neutral position, the handle 14 can be used to steady the shaft 12 while the shaft 12 is rotated by a tool such as a socket wrench (not shown) engaged with the drive socket 18.

When the spring 42 is rotated in a clockwise direction as shown in FIG. 4, the upper end of the pawl 34 is urged into contact with the toothed element 30 to provide a ratcheting action in which the handle 14 is allowed to rotate freely in the clockwise direction, but is substantially prevented from rotating in the counterclockwise direction. Conversely, when the spring 42 is moved downwardly as shown in FIG. 5, the lower end of the pawl 34 is pressed into engagement with the toothed element 30, thereby allowing counterclockwise rotation of the handle 14 while preventing clockwise rotation. Throughout this paragraph, directions and positions are discussed with reference to FIGS. 3–5.

Returning to FIG. 2, the quick release mechanism 16 is in many respects similar to the quick release mechanism described in U.S. Pat. No. 5,644,958, the entirety of which is hereby incorporated by reference for its teaching of a suitable construction for the quick release mechanism 16. As described in greater detail in U.S. Pat. No. 5,644,958, the quick release mechanism 16 includes a locking element which in this embodiment takes the form of a pin 56. The pin 56 slides in a passageway 58 that is obliquely oriented with respect to the longitudinal axis L and extends between openings in the out-of-round drive portion 22 and the adjacent portion 24. The pin 56 includes a first end 60 at the out-of-round drive portion 22 and a second end 62 at the adjacent portion 24. The pin 56 is movable in the passageway 58 between a tool attachment engaging position (as shown in FIG. 2), in which the first end 60 is positioned to engage a tool attachment such as a socket to hold the tool attachment in place on the drive portion 22. The alternate position is a tool attachment releasing position (not shown, but similar to that shown in U.S. Pat. No. 5,644,958) in which the first end 60 is received substantially within the passageway 58, and the tool attachment is released from the drive portion 22. The pin 56 is biased away from the out-of-round drive portion 22 by a releasing spring 64.

The position of the pin 56 in the passageway 58 is controlled by an actuator 66. In this embodiment, the actuator 66 includes a ring 68 that is biased against the pin 56 by an engaging spring 70. The ring 68 can be lifted away from the drive portion 22 (upwardly as shown in FIG. 2) by a collar 72 that defines a ledge 74 that engages the ring 68. When no external forces are applied to the actuator 66, the spring 70 presses the ring 68 against the pin 56 with sufficient force to compress the spring 64 and to move the first end 60 of the pin 56 outwardly, to the tool attachment engaging position shown in FIG. 2.

A significant improvement of the quick release mechanism 16 is that the ring 68 is substantially symmetrical about a mid-plane 76 oriented perpendicularly to the shaft 12. The ring 68 defines first and second side surfaces 78, 80 that are parallel to one another in this embodiment. Either of the side surfaces 78, 80 is well suited for contact with the second end 62 of the pin 56. For this reason, there is no preferred orientation for the ring 68 on the shaft 12, and there is therefore no need to orient the ring 68 in a preferred orientation at the time of assembly. This simplifies assembly of the quick release mechanism. In alternate embodiments, the ring 68 may have non-parallel side surfaces 78, 80, and may be shaped as a triangle or a trapezoid in cross section, for example. The engaging spring 70 may be adapted to optimize its performance with the different rings 68.

From the foregoing, it should be apparent that an improved extension bar has been described having a ratcheting handle 14. The control ring 48 can be used to set the ratchet mechanism for clockwise ratcheting action, counterclockwise ratcheting action, or free-wheeling. When clockwise or counterclockwise ratcheting action is selected, the handle 14 can be used manually to tighten or loosen a fastener with a tool attachment such as a hex tool, a torx tool, a socket-mounted bit (slotted, philips or torx) or a socket (not shown) attached to the drive stud 20. When the ratchet mechanism is positioned in the freewheeling position, the freewheeling handle 14 can be used as a guide to steady the shaft 12 as it is being rotated by a conventional socket wrench (not shown) engaged with the drive socket 18. The improved quick release mechanism described above is particularly simple to assemble in view of the symmetrical shape of the ring 68.

The term "extension bar" is intended broadly to encompass any structure with a socket at one end, a drive stud at the other end, and at least one torque-transmitting element therebetween. Thus, an extension bar may be shorter or longer than the illustrated embodiment, and it may include additional elements such as T-bars, universal joints, and the like.

Of course, many changes and modifications can be made to the preferred embodiment described above. For example, the shaft may be tubular rather than solid. If desired, the toothed element of the ratchet mechanism can be mounted on the shaft and the pawl can be mounted to rotate with the handle. The locking element can take many forms other than that of the pin 56, and in some cases may be formed of multiple components. Proportions can be varied as desired, and some embodiments may be substantially shorter in length and suited for use as a palm wrench. The relative lengths of the parts 14, 28, 54 along the longitudinal axis may vary greatly, and the part 54 may be shaped as a ring if desired. The ratcheting handle and quick-release mechanism can be used on a shaft that does not include a socket and is therefore not an extension bar.

The foregoing detailed description has described only a few of the many forms that this invention can take. For this reason, the detailed description should be taken by way of illustration and not by way of limitation. It is only the following claims, including all equivalents, that are intended to define the scope of this invention.

What is claimed is:

1. An extension bar comprising:

a shaft comprising first and second ends and an intermediate portion extending therebetween, said first end comprising a drive socket, said second end comprising a drive stud;

a handle rotatably mounted around the shaft between the first and second ends, said handle comprising a gripping surface extending alongside the shaft on at least two opposed sides of the shaft; and a ratchet mechanism coupling the handle to the shaft.

2. An extension bar comprising:

a shaft comprising first and second ends and an intermediate portion extending therebetween, said first end comprising a drive socket, said second end comprising a drive stud;

a handle rotatably mounted around the shaft between the first and second ends; and a ratchet mechanism coupling the handle to the shaft;

said ratchet mechanism comprising a pawl mounted to rotate with the shaft and an internally toothed element mounted to rotate with the handle.

3. The invention of claim 2 wherein the handle comprises a gripping surface extending alongside the shaft on at least two opposed sides of the shaft.

4. The invention of claim 1 or 2 wherein the drive socket is at least partially embedded in the handle.

5. The invention of claim 1 or 2 wherein the drive socket is substantially completely embedded in the handle.

6. The invention of claim 1 or 3 wherein the gripping surface extends substantially completely around the shaft.

7. The invention of claim 1 or 2 wherein the ratchet mechanism comprises a ratchet direction control element operable by a user to select at least a clockwise and a counterclockwise ratcheting action.

8. The invention of claim 7 wherein the ratchet direction control element comprises a ring extending around the shaft.

9. The invention of claim 7 wherein the handle is disposed at least in part between the drive socket and the ratchet direction control element.

10. The invention of claim 7 wherein the ratchet direction control element is disposed at least in part on a side of the ratchet mechanism facing the drive stud.

11. The invention of claim 1 or wherein the gripping surface is oriented generally parallel to a line extending between the first and second ends of the shaft.

12. The invention of claim 1 or 2 wherein the gripping surface is generally cylindrical in shape, and wherein the gripping surface extends around the shaft.

13. The invention of claim 1 or 2 wherein a majority of the gripping surface is disposed between the drive socket and the drive stud.

* * * * *

UNITED STATES PATENT AND TRADEMARK OFFICE

CERTIFICATE OF CORRECTION

PATENT NO. : 6,182,536 B1
DATED : February 6, 2001
INVENTOR(S) : Peter M. Roberts et al.

It is certified that error appears in the above-identified patent and that said Letters Patent is hereby corrected as shown below:

Claim 11,
Line 1, insert -- 2 -- before "wherein".

Signed and Sealed this

Twelfth Day of March, 2002

*Attest:*

*Attesting Officer*

JAMES E. ROGAN
*Director of the United States Patent and Trademark Office*